US006601883B1

(12) United States Patent
Kalsi

(10) Patent No.: US 6,601,883 B1
(45) Date of Patent: Aug. 5, 2003

(54) VEHICLE DOOR LATCH

(75) Inventor: Gurbinder Singh Kalsi, West Midlands (GB)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 09/763,275

(22) PCT Filed: Aug. 4, 1999

(86) PCT No.: PCT/GB99/02566

§ 371 (c)(1),
(2), (4) Date: Feb. 20, 2001

(87) PCT Pub. No.: WO00/11290

PCT Pub. Date: Mar. 2, 2000

(30) Foreign Application Priority Data

Aug. 19, 1998 (GB) ..... 9817954

(51) Int. Cl.[7] ..... E05C 3/06
(52) U.S. Cl. ..... 292/216; 292/201; 292/DIG. 23
(58) Field of Search ..... 292/216, DIG. 23, 292/201

(56) References Cited

U.S. PATENT DOCUMENTS

| | | | | |
|---|---|---|---|---|
| 4,342,209 A | * | 8/1982 | Kleefeldt | 292/DIG. 23 |
| 4,478,004 A | | 10/1984 | Andrei-Alexandru et al. | |
| 4,858,971 A | * | 8/1989 | Haag et al. | 292/201 |
| 5,309,745 A | * | 5/1994 | Ursel et al. | 292/201 |
| 5,454,608 A | * | 10/1995 | Dzurko et al. | 292/216 |
| 5,613,716 A | * | 3/1997 | Cafferty | 292/216 |
| 5,653,484 A | * | 8/1997 | Brackmann et al. | 292/216 |
| 5,685,579 A | * | 11/1997 | Funk et al. | 292/216 |
| 5,713,613 A | | 2/1998 | Honma et al. | |
| 5,803,515 A | * | 9/1998 | Arabia et al. | 292/201 |
| 5,901,991 A | * | 5/1999 | Hugel et al. | 292/201 |
| 5,921,595 A | * | 7/1999 | Brackmann et al. | 292/201 |

FOREIGN PATENT DOCUMENTS

| | | |
|---|---|---|
| DE | 3626441 | 8/1986 |
| EP | 0271635 | 7/1987 |
| EP | 0775791 | 5/1997 |
| EP | 0828049 | 3/1998 |
| GB | 2 328 242 A | 2/1999 |
| GB | 2 329 416 A | 3/1999 |
| GB | 2 339 593 A | 2/2000 |

* cited by examiner

*Primary Examiner*—Robert J. Sandy
*Assistant Examiner*—Thomas Ho
(74) *Attorney, Agent, or Firm*—Carlson, Gaskey & Olds

(57) ABSTRACT

A vehicle door latch assembly has an unlatching mechanism that includes an input member and an output member that are releasably drive connected together. An overriding element carries the input member and the output member into and out of drive connection and is urged in a clutch disconnecting condition. If the overriding element is displaced into a clutch connecting condition, power actuation of the input member is possible after a manually operable release member is shifted to disengage a latching pawl out of engagement from a latch. The overriding element prevents disengagement of the latch if there is a malfunction in the power actuator and ensures that power unlatching can be initiated only by the release member.

10 Claims, 3 Drawing Sheets

VEHICLE DOOR LATCH

BACKGROUND OF THE INVENTION

This invention relates to latches for vehicle doors, particularly for light passenger and goods vehicles.

Powered locking and powered latching of doors is becoming more favored, both as part of central locking systems and to enable more effective weathersealing of doors and greater freedom in styling and design. There are also advantages in providing for power actuated unlatching of doors in terms of dispensing with much of the mechanical linkage and components needed for conventional manual inside and outside door handles and in providing unitary lock and latch modules of standard form which can be speedily installed in doors of a wide range of vehicle models and types without special adaptation.

An example of the provision of power closing is described and claimed in our co-pending application, Publication Number GB 2328242 dated Feb. 17, 1999, and the present invention may conveniently be combined with that construction if desired.

Examples of the provision of power actuated unlatching are described and claimed in our co-pending patent applications, Publication Numbers GB 2329416 dated Mar. 24, 1999 and GB 2339593 dated Feb. 2, 2000.

SUMMARY OF THE INVENTION

The object of the invention is to provide improvements in vehicle door latches having a power unlatching facility in an economical, effective and reliable form, and providing enhanced safety in their use and operation.

A vehicle door latch assembly includes a latch operatively co-acting with a striker as the door nears a closed position. A latching pawl self-engages with the latch and holds the latch in a latched condition, retaining the door. An unlatching mechanism is selectively operable to disengage said latching pawl for opening the door and includes a pawl lifter movable from a position of rest to carry the latching pawl out of engagement with the latch and a manually operable release member operatively linked to a handle of the door to engage and displace the pawl lifter from the position of rest. The unlatching mechanism also includes a power output member movable to engage and displace the pawl lifter from the position of rest, an input member power actuated between a first position and a second position which is releaseably drive connected to the output member to cause shifting of the output member as the input member moves to the second position, and an overriding element carrying the input member and the outlet member into and out of drive connection and being resiliently urged to a clutch disconnecting condition. The release member includes a formation co-acting with the overriding element to displace the overriding element to a clutch connecting condition. Power actuation of the input member occurs after shifting of the release member According to the invention there is provided a vehicle door latch assembly as defined by Claim 1 of the appended claims.

BRIEF DESCRIPTION OF THE DRAWINGS

An example of the invention is now more particularly described with reference to the accompanying drawings in which.

DETAILED DESCRIPTION OF THE PREFERRED EMBODIMENTS

Figure 1:
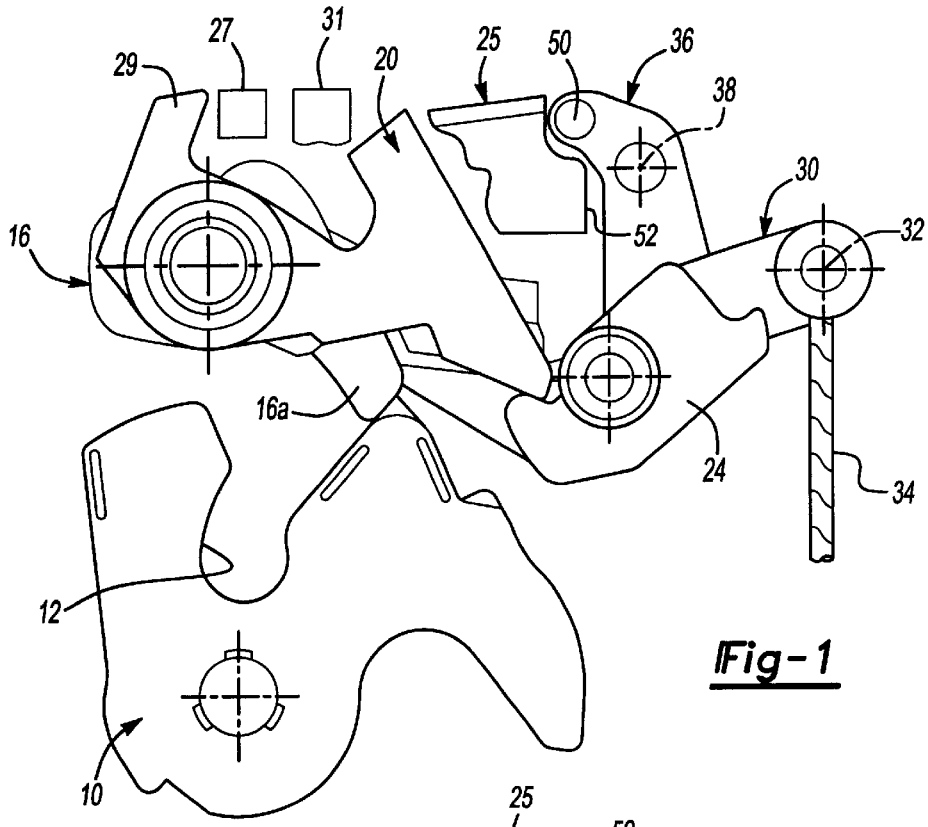
FIG. 1 is a diagram of parts of a vehicle door latch assembly in a rest position with some parts not relevant to the invention removed for clarity.

Referring firstly to FIG. 1, the latch assembly, which will be operatively secured in a door in known manner, includes a conventional rotating latch claw 10 having a mouth 12 for co-acting with a striker operatively mounted to the associated door post. Claw 10 is biased by a claw spring in a counterclockwise direction. A pawl tooth 16A of a latching pawl 16 self engages with the claw 10 in known manner to retain it, and hence the door, releasably at a first safety position at which the door is near closed, and an inner position shown in FIG. 1 at which the door is fully shut.

The assembly may include powered closing/latching of the door as described in our said co-pending patent application Publication number GB 2328242.

Unlatching means includes a pawl lifter 20 in the form of a lever pivoted co-axially with pawl 16 which engages the pawl 16 when angularly displaced from its position of rest shown in FIG. 1, so causing disengagement of pawl 16 from claw 10 to free the door for opening. Manually operable release means of the assembly is of known construction including a release lever 25, best seen in FIG. 4, operatively connected to the inside and outside door handles and pivoted co-axially but independently of pawl lifter 20, overlying the pawl lifter 20 as viewed in FIGS. 1 to 3 in which parts of said lever 25 are broken away for clarity. Motion of lever 25 is only transmitted to operate pawl lifter 20 when a lock link 27 (shown in part in FIG. 1 only) is positioned between a drive projection 29 of lifter 20 and a drive projection 31 of lever 25. When lock link 27 is withdrawn lever 25 is disabled from moving pawl lifter 20 so locking the door so far as manual release is concerned.

Figure 4:
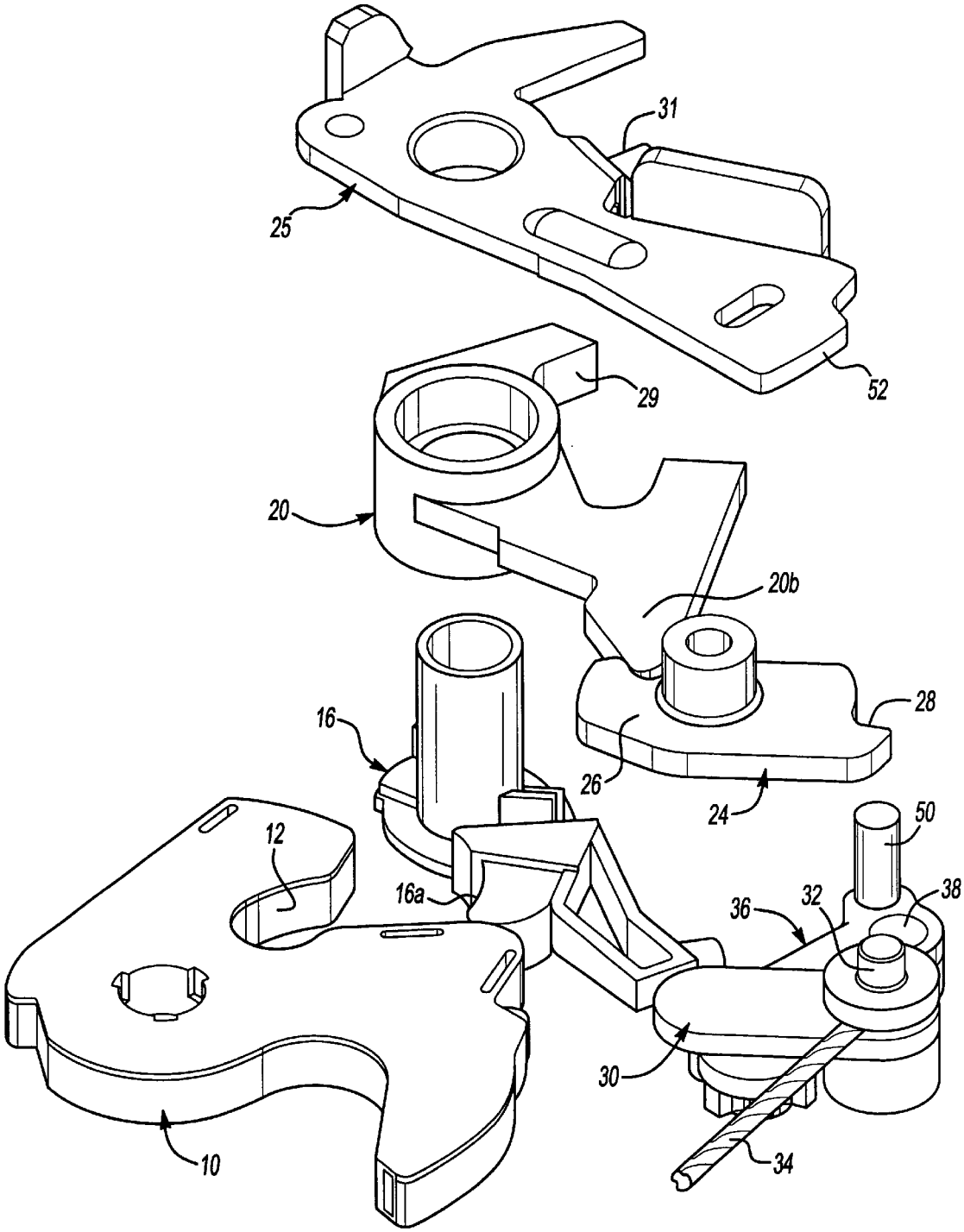
FIG. 4 is a perspective view of said parts of the assembly.

An output member in the form of a power release lever 24, best seen in FIG. 4, is fulcrummed on a fixed pivot whose axis is parallel to the claw axis. Its left-hand arm 26 is positioned to engage the lower face of a rightward extension 20B of pawl lifter 20 so that when it is turned clockwise it displaces lifter 20 and so causes disengagement of pawl 16 independently of the manually operable release means. The right hand arm of lever 24 terminates in a drive formation in the form of a shoulder 28.

Figure 2:
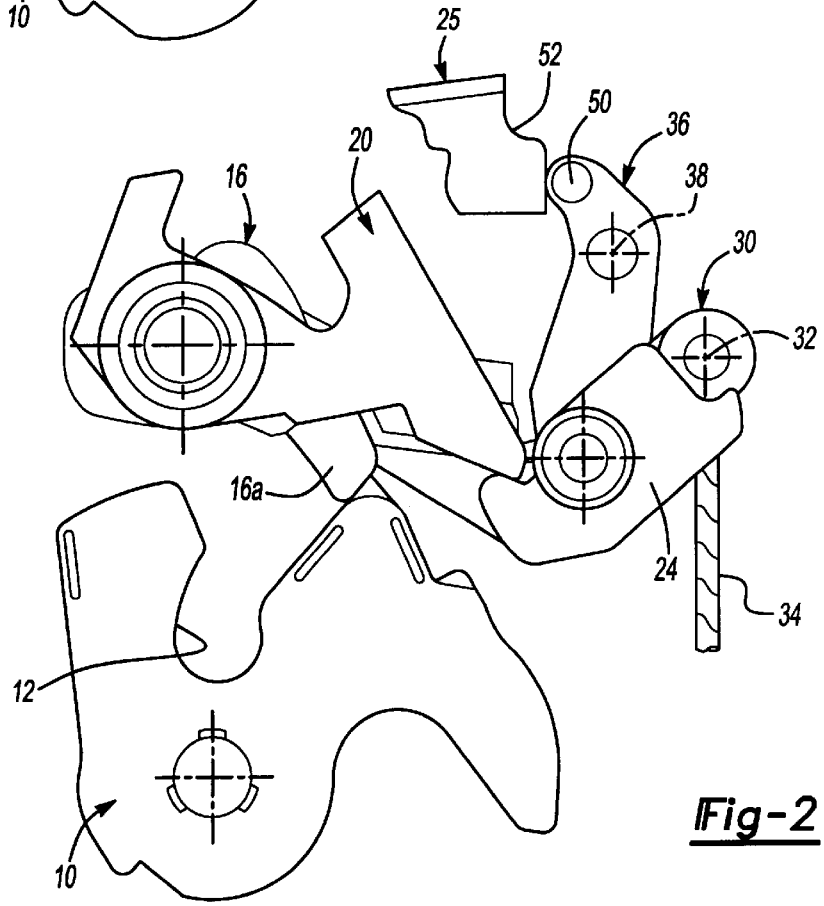
FIG. 2 is a like diagram showing the parts during a power unlatching operation.
Figure 3:
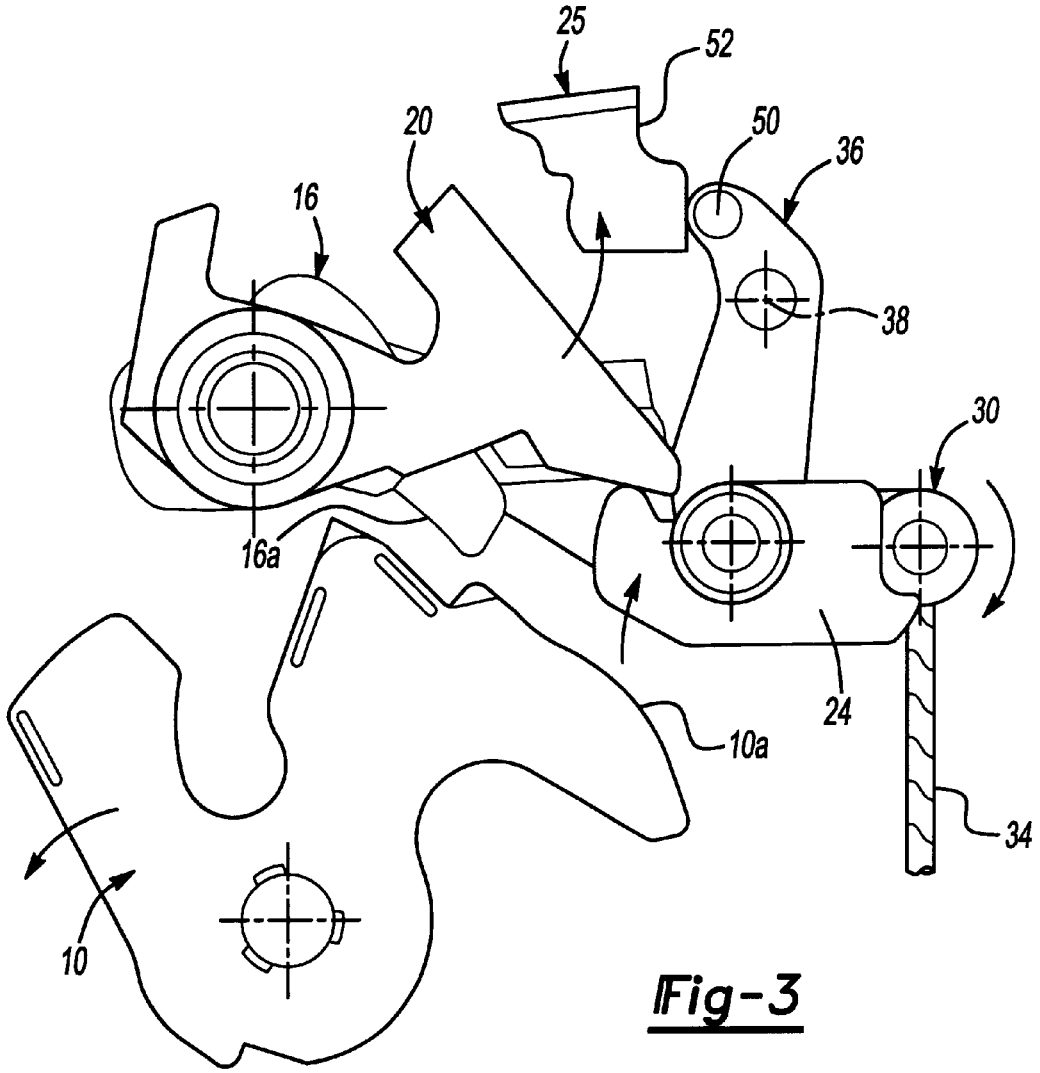
FIG. 3 is a like diagram with the parts in a door released position.

An input member in the form of a crank 30 extending alongside said right hand arm has a drive pin 32 which, is engageable with shoulder 28 so that clockwise angular movement of crank 30 is transmitted to lever 24 (see FIGS. 1 and 2). An electric push-pull actuator motor is coupled to crank 30 by a vertical power drive link 34, selectively operable to drive crank 30.

Crank 30 is pivoted on the lower end of a swinging overriding element 36, the upper end of which is mounted on a fixed pivot 38 in spaced parallel relationship to the axis of release lever 24. In the angular position shown in FIGS. 2, 3 and 4 the pivot axes of crank 30 and lever 24 are substantially coincident, so maintaining the clutch means constituted by shoulder 28 and pin 32 in drive engagement.

Release lever 24 is resiliently urged counterclockwise to its FIG. 1 position, and overriding element 36 is also resiliently urged anti-clockwise to the position shown in FIG. 1 in which the clutch means is disengaged.

Overriding element 36 is the form of a bell-crank lever having a longer arm on which crank 30 is pivoted and a shorter arm at its upper end carrying a follower formation in the form of a camming pin 50. The right hand end edge of release lever 25 is formed to provide a stepped camming face 52 co-acting with pin 50. In the rest position of FIG. 1 pin 50 abuts the part of face 52 which is at lesser radius from the axis of lever 25 so that the crank 30 is displaced to the right, positioning pin 32 out of drive engagement with shoulder 28. In this condition powered unlatching cannot occur. This is an important safety feature in that any malfunctioning of the actuator or its power supply and control circuitry, e.g. due to a short circuit or ingress of moisture causing the actuator to run uncommanded will not be transmitted to pawl lifter 20 as even if crank 30 is power shifted element 36 remains unaffected. It will be realized that inadvertent power unlatching, particularly while a vehicle was in motion and possibly at high speed, could be very dangerous.

Power unlatching can only be initiated by movement of the release lever 25, i.e. by operation of either door handle. Lever 25 has to be shifted to a predetermined angular extent from the rest position of FIG. 1 to put the mechanism in the condition shown in FIG. 2. Here pin 50 is engaged with the larger radius part of camming face 52 by counterclockwise movement of lever 25 moving camming overriding element 36 clockwise and drawing link 30 to engage the clutch means (shoulder 28 and pin 32). At the same time a switch will operate to power the actuator motor, turning release lever 24 clockwise to operate pawl lifter 20 and unlatch the door by putting the mechanism in the condition shown in FIG. 3, this taking place without the user having to further move or operate the door handle. With the handle released and ceasing of power actuation the mechanism will self-restore to the rest condition shown in FIG. 1. It will be seen that as this rest condition declutches the power actuator drive, the mechanism associated with the latter cannot block or impede subsequent closing and relatching of the door or unlatching by manual operation as referred to above independently of the power unlatching provision. The door can still be opened and closed in the normal way even if power actuation should fail, for example due a flat battery.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A vehicle door latch assembly comprising:

a latch;

a latching pawl self-engaging with said latch to hold said latch in a latched condition;

an unlatching mechanism selectively operable to disengage said latching pawl, said unlatching mechanism including a pawl lifter movable from a position of rest to carry said latching pawl out of engagement with said latch, a manually operable release member operatively linked to a door handle for movement to engage and displace said pawl lifter from said position of rest, a power output member movable to engage and displace said pawl lifter from said position of rest, an input member power actuated between a first position and a second position, said input member being releasably drive connected to said output member to cause shifting of said output member as said input member moves to said second position, and an overriding element carrying said input member and said output member into and out of drive connection and being urged to a clutch disconnecting condition, wherein said release member includes a formation capable of co-acting with said overriding element to maintain said overriding element in a clutch connecting condition only when said release member is in an actuated position, thereby preventing power actuation of the output member by the input member unless said release member is actuated.

2. The assembly as recited in claim 1 wherein said latch is a pivotally mounted claw.

3. The assembly as recited in claim 1 wherein said output member is a power release lever having a first arm positioned for engagement with said pawl lifter and a second arm provided with an output drive formation releasably connected to said input member.

4. The assembly as recited in claim 1 wherein said input member is a crank element coupled to a power actuator for angular movement and carrying an input drive formation releasably connected to said output member, a pivot of said crank element being carried on said overriding element so that shifting of said overriding element carries said input drive formation into and out of engagement with said output drive formation.

5. The assembly as recited in claim 1 wherein said release member is a pivoted lever including a camming formation co-acting with a follower formation on said overriding element.

6. A vehicle door latch assembly comprising:

a latch;

a latching pawl self-engaging with said latch to hold said latch in a latched condition;

an unlatching mechanism selectively operable to disengage said latching pawl, said unlatching mechanism including a pawl lifter movable from a position of rest to carry said latching pawl out of engagement with said latch, a manually operable release member operatively linked to a door handle for movement to engage and displace said pawl lifter from said position of rest, a power output member movable to engage and displace said pawl lifter from said position of rest, a power actuator motor;

an input member actuatable by said power actuator motor between a first position and a second position, said input member being releasably drive connected to said output member to cause shifting of said output member as said input member moves to said second position, and an overriding element carrying said input member and said output member into and out of drive connection and being urged to a clutch disconnecting condition, wherein said release member includes a formation capable of co-acting with said overriding element to displace said overriding element in a clutch connection condition and wherein the power actuator motor power actuates said input member after shifting of said release member to displace the pawl lifter from said position of rest.

7. The assembly as recited in claim 6 wherein said latch is a pivotally mounted claw.

8. The assembly as recited in claim 6 wherein said output member is a power release lever having a first arm positioned for engagement with said pawl lifter and a second arm provided with an output drive formation releasably connected to said input member.

9. The assembly as recited in claim 6 wherein said input member is a crank element coupled to a power actuator for angular movement and carrying an input drive formation releasably connected to said output member, a pivot of said crank element being carried on said overriding element so that shifting of said overriding element carries said input drive formation into and out of engagement with said output drive formation.

10. The assembly as recited in claim 6 wherein said release member is a pivoted lever including a camming formation co-acting with a follower formation on said overriding element.

* * * * *